US007942988B2

(12) United States Patent
Subramanian et al.

(10) Patent No.: US 7,942,988 B2
(45) Date of Patent: May 17, 2011

(54) SHAPED, FLEXIBLE FUEL AND ENERGETIC SYSTEM THEREFROM

(75) Inventors: Shanthi Subramanian, Skillman, NJ (US); Declan Farrell, County Dublin (IE); Santosh Y. Limaye, El Cajon, CA (US)

(73) Assignee: Vesta Research, Ltd., Dublin (IE)

( * ) Notice: Subject to any disclaimer, the term of this patent is extended or adjusted under 35 U.S.C. 154(b) by 451 days.

(21) Appl. No.: 12/116,977

(22) Filed: May 8, 2008

(65) Prior Publication Data

US 2009/0101251 A1 Apr. 23, 2009

Related U.S. Application Data

(60) Provisional application No. 60/916,593, filed on May 8, 2007.

(51) Int. Cl.

| | |
|---|---|
| ***C06B 45/00*** | (2006.01) |
| ***C06B 45/04*** | (2006.01) |
| ***C06B 45/06*** | (2006.01) |
| ***C06B 45/08*** | (2006.01) |
| ***C06B 27/00*** | (2006.01) |
| ***D03D 23/00*** | (2006.01) |
| ***D03D 43/00*** | (2006.01) |

(52) U.S. Cl. ..... 149/20; 149/2; 149/17; 149/18; 149/87; 149/108.8; 149/109.2; 149/109.4

(58) Field of Classification Search ..... 149/20, 149/2, 17, 18, 87, 108.8, 109.2, 109.4
See application file for complete search history.

(56) References Cited

U.S. PATENT DOCUMENTS

| | | | | |
|---|---|---|---|---|
| 3,159,104 | A | 12/1964 | Hodgson | |
| 3,513,043 | A * | 5/1970 | Burnside | 149/19.3 |
| 4,312,272 | A | 1/1982 | Baker et al. | |
| 4,869,170 | A | 9/1989 | Dahmberg et al. | |
| 5,738,374 | A | 4/1998 | Marsaud et al. | |
| 6,062,143 | A | 5/2000 | Grace et al. | |
| 6,241,281 | B1 * | 6/2001 | Hinshaw et al. | 280/741 |
| 6,247,410 | B1 | 6/2001 | Garcia | |
| 6,803,244 | B2 | 10/2004 | Diener et al. | |
| 6,883,037 | B2 * | 4/2005 | Kadatch et al. | 710/5 |
| 6,979,022 | B2 | 12/2005 | Smith et al. | |
| 6,984,274 | B2 | 1/2006 | Hofmann et al. | |
| 2003/0183109 | A1 | 10/2003 | Rudhard et al. | |
| 2004/0161369 | A1 | 8/2004 | Chan et al. | |
| 2004/0166319 | A1 * | 8/2004 | Li et al. | 428/404 |
| 2004/0244889 | A1 * | 12/2004 | Sailor et al. | 149/2 |
| 2005/0072502 | A1 | 4/2005 | Hofmann et al. | |
| 2006/0251562 | A1 | 11/2006 | Farrell et al. | |

FOREIGN PATENT DOCUMENTS

| | | |
|---|---|---|
| RU | 2169133 C2 | 12/1999 |

OTHER PUBLICATIONS

Ernst-Christian Koch and Dominik Clement, "Special Materials in Pyrotechnics: VI. Silicon—An Old Fuel with New Perspectives," Propellants, Explosives, Pyrotechnics, 2007, pp. 205-212, vol. 32, No. 3, Wiley-VCH Verlag Gmbh & Co. KGaA, Weinheim.

D. Clement, J. Diener, E. Gross, N. Kunzner, V. Yu. Timoshenko, D. Kovalev, "Highly Explosive Nanosilicon-based Composite Materials," Phys. Stat. Sol., 2005, pp. 1357-1364, vol. 202, No. 8, Wiley-VCH Verlag Gmbh & Co. KGaA, Weinheim.

* cited by examiner

*Primary Examiner* — James E McDonough
(74) *Attorney, Agent, or Firm* — Joy L. Bryant

(57) ABSTRACT

A shaped, flexible fuel and energetic system is presented. The shaped, flexible fuel comprises at least one polymeric binding material and porous silicon particles dispersed throughout the polymeric binding material. The porous silicon particles are prepared from a metallurgical grade silicon powder. The shaped, flexible fuel preferably includes shapes such as: an article, a film, a wire and a tape. The energetic system comprises the shaped, flexible fuel portion used alone or in combination with at least one oxidizer.

18 Claims, 1 Drawing Sheet

SHAPED, FLEXIBLE FUEL AND ENERGETIC SYSTEM THEREFROM

CROSS-REFERENCE TO RELATED APPLICATIONS

This application claims the benefit of U.S. Provisional Patent Application Ser. No. 60/916,593, entitled, "Shaped, Flexible Fuel and Energetic System Therefrom," filed May 8, 2007, which is hereby incorporated by reference in its entirety.

FIELD OF THE INVENTION

The present invention is related to energetic materials. In particular, it is related to shaped, flexible energetic systems prepared from porous silicon particles.

BACKGROUND OF THE INVENTION

Many industrial applications require the use of a material that is capable of generating a pulse of energy in a short amount of time. Such applications include but are not limited to fuses or igniters for pulse producing, gas producing, light producing, flame producing, and shock wave producing media. These fuses or igniters are particularly useful for projectiles, flying objects, and missiles as well as for firing explosives and igniting propellant charges and pyrotechnic charges. Alternative applications include chip-integrated ultra-fast heating elements for mass spectrometry or for the destruction of EPROMs. These substances require high energy densities and high energy liberation rates in comparison with conventional reactive materials.

Various parameters have been used to characterize explosive materials. For example, high temperature (12,000 K); fast reaction progress (greater than 104 m/s); and high energy density (28 kJ/g) are a few known parameters.

Diener et al. (U.S. Pat. No. 6,803,244) describe a nanostructured reactive substance and process for producing same by intermixing silicon and an oxidizing agent on a nanometer size scale. The fuel and the oxidizing agent are separated by a barrier layer. When the barrier layer is broken open, the fuel and oxidizing agent make contact and react, liberating energy. The source of silicon for the application is porous silicon produced by electrochemical etching of crystalline silicon (silicon discs, wafers). A spongy structure including a silicon lattice and pores or cavities (holes) results. Oxidizing agents are introduced into the pores. The surface of the remaining silicon structures is covered with a monolayer of atomic hydrogen. The silicon-hydrogen bond at the surface of the nanostructured lattice is relatively weak and thus the mixture of the fuel (silicon) and oxidizing agent which is present on the nanometer size scale in the pores is relatively unstable. It is necessary to effect additional passivation of the surface of the silicon lattice in order to increase stability. This is accomplished by heat treatment of the samples in an oxygen atmosphere, thus forming a barrier or protective layer and increasing stability of the samples when the pores are filled with an oxidizing agent. Powders have been formed from small, nanometer-size silicon particles (colloids) in addition to etching pores into a solid piece of silicon. Solid bodies have been formed by enclosing the silicon particles with a layer of oxidizing agent and then compacting them. The thickness of the barrier or protective layer applied to or encasing the silicon particles determines the spacing of the particles. Alternatively, individual silicon nanocrystals are interconnected by surface atoms on the silicon particles. In this instance, the functional groups function as spacers and also as a provider for an oxidant. The advantage is that there are no connecting arms between the nanometer-size silicon structure which can easily break under the effect of an impact, causing an unintended reaction. Although the compactable body can be geometrically freely shaped, the resulting shape is rigid and not flexible. Hence, flexible materials such as tapes, films, and wires cannot be produced.

Hoffman et al. (U.S. Pat. No. 6,984,274) describe an explosive composition comprising a porous fuel and an oxidizer. The porous fuel is a solid, preferably in the form of a structurally stable shaped body in which the fuel is present as a rigid structural matrix, such as porous silicon. The inner surface of the fuel is at least partially saturated with oxygen or modified in another way so as to increase the activation energy that has to be overcome so that there can be a reaction with the oxidizer. Typically, passivation takes place by heating the fuel in an atmosphere containing oxygen or in air. A less reactive protective layer is found on the surface of the nanocrystals. This passivation layer can be applied subsequently onto the porous fuel and can consist of an inert material (Teflon). Since the fuel is present in the form of a solid, shape imparting matrix, the composition is typically used as a load-bearing component in pyrotechnical devices or as a detonating agent or a component of an igniter. However, this material is not suitable for making flexible articles, films, wires or tapes.

An object of the present invention is to provide a shaped, flexible fuel.

Another object of the present invention is provide an energetic system which employs the shaped, flexible fuel.

SUMMARY OF THE INVENTION

A shaped, flexible fuel and energetic system which uses the shaped, flexible fuel is presented. By the term "energetic" it is meant that the system is capable of releasing energy into the environment upon initiation. The energy release can range from extremely rapid as in a detonation reaction or over a period of time such as in deflagration or burning. In a detonation reaction, the reaction speed is supersonic and the decomposition occurs by passage of shockwaves through a material. In a deflagration reaction, the speed is sub-sonic and the reaction propagates by thermal means. The system of the present invention comprises a shaped, flexible fuel portion and at least one oxidizer. The shaped, flexible fuel portion comprises at least one polymeric binding material and porous silicon particles dispersed throughout the polymeric binding material. The porous silicon particles are prepared from a metallurgical grade silicon powder. The shaped, flexible fuel portion preferably includes an article, a film, a wire and a tape.

The present invention is useful for releasing energy into the environment. The shaped, flexible fuel portion is capable of self-ignition at temperatures ranging from about 300° C. to about 1000° C. Alternatively, an oxidizer is added to the shaped, flexible fuel portion such that the porous silicon particles come into contact with the oxidizer (through methods such as mixing or impregnation). A reaction is initiated in these silicon particles wherein energy is released to the environment.

Tapes, wires, films and shaped articles are prepared from the shaped, flexible energetic system. Examples of shaped articles include but are not limited to: a cylinder; a cone; and a sphere. As another embodiment, these articles are combined with secondary explosives to serve as blast enhancers.

Additional objects and advantages of the invention will be set forth in part in the description which follows, and in part, will be obvious from the description, or may be learned by practice of the invention. The objects and advantages of the invention will be obtained by means of instrumentalities in combinations particularly pointed out in the appended claims.

BRIEF DESCRIPTION OF THE DRAWING

The accompanying drawing illustrates a complete embodiment of the invention according to the best modes so far devised for the practical application of the principals thereof, and in which.

DETAILED DESCRIPTION OF THE PREFERRED EMBODIMENTS

Figure 1:
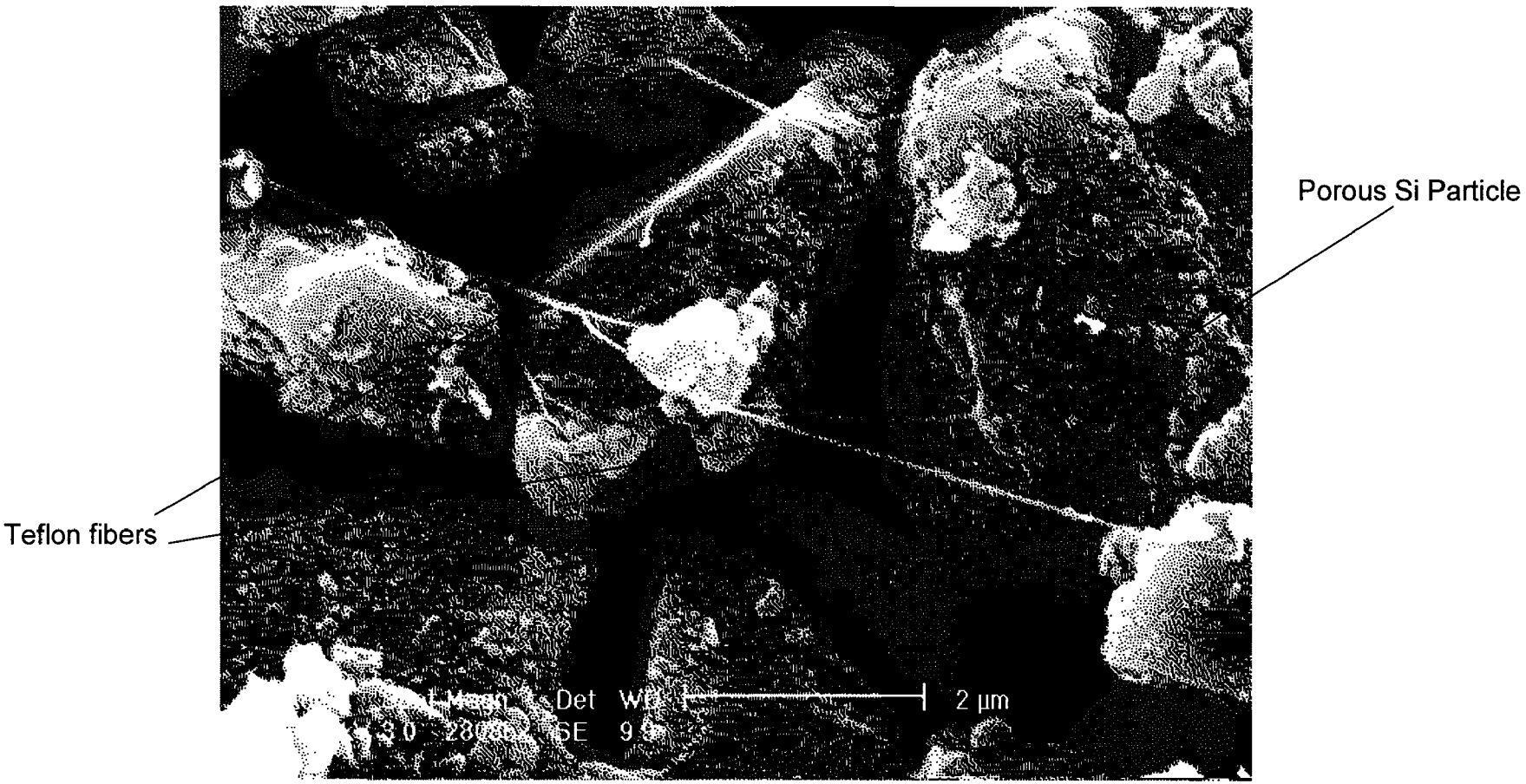
FIG. 1 is a Scanning Electron Micrograph of the tape of the present invention.

Silicon nanosponge particles prepared from metallurgical grade silicon powder are described in U.S. Patent Application Publication No. US 2006/0251561A1, which is hereby incorporated by reference in its entirety. Porous silicon particles prepared from metallurgical grade silicon powder are described in US Patent Application Publication No. US 2006/0251562A1, which is hereby incorporated by reference in its entirety. Both of these materials are prepared by chemically etching metallurgical grade silicon powders in HF-nitric acid solutions. The metallurgical grade silicon powders have particle sizes ranging from about 1 micron to about 100 microns. The chemical etching process causes the particles to have mean pore sizes in the range from about 4-7 nm, surface areas in the range from about 25-300 $m^2/g$ and pore volumes up to about 0.5 cc/g. It has now been recently discovered that such materials are suitable for producing shaped, flexible energetic systems where it is desirable to release energy into the environment upon initiation. The energy release can range from extremely rapid as in a detonation reaction or over a period of time such as in deflagration or burning. In a detonation reaction, the reaction speed is supersonic and the decomposition is through the passage of shockwaves through a material. In a deflagration reaction, the speed is sub-sonic and the reaction propagates by thermal means.

In general, the shaped, flexible fuel comprises a polymeric binding material and porous silicon particles dispersed throughout the polymeric binding material. The porous silicon particles are prepared from metallurgical grade silicon powder. The shaped, flexible fuel is used in its "neat" form (without any additional additives) to serve as a source for releasing energy into the environment or a shaped, flexible energetic system is prepared from the shaped, flexible fuel and includes at least one oxidizer.

Three approaches are employed when using the shaped, flexible energetic system of the present invention. In one embodiment of the invention, the fuel portion is shaped and is capable of self-ignition at temperatures ranging from about 300° C. to about 1000° C. In another embodiment of the invention, the fuel portion is shaped and an oxidizer is subsequently added to the fuel portion. Alternatively, the oxidizer is added to the fuel portion prior to shaping and the fuel and oxidizer are then shaped to form the shaped, flexible energetic system.

Regardless of the method of manufacture employed, the fuel is shaped and flexible. The shaped, flexible fuel imparts uniqueness to the invention and distinguishes it from systems of the prior art, where those systems are typically rigid and shape is limited. The fuel portion of the present invention comprises at least one polymeric binding material. Any polymeric binding material known to one of ordinary skill in the art may be employed for the present invention. Preferably, the polymeric binding material is a thermoplastic polymer. Most preferably, the thermoplastic polymer is a poly(tetrafluoroethylene) powder which is present at an amount ranging from about 5 percent by weight to about 70 percent by weight of the total formulation. The advantage to using thermoplastic polymers is that their low melting point allows for processing below temperatures of self-ignition and initiation when an oxidizer is present or below 300° C. in the absence of an oxidizer where it is desirable to maintain a hydrogen terminated surface on the porous silicon particles. In addition, such polymers enable manufacturing by methods such as ram or extrusion processing. The polymeric binding material is either a homopolymer (single polymer) or a polymer blend (at least two different polymers used in combination).

Dispersed throughout the polymeric binding material are porous silicon particles. The porous silicon particles are prepared from a metallurgical grade silicon powder. In one embodiment of the invention, the porous silicon particles have an initial particle size ranging from about 1 micron to about 4 microns. Each porous silicon particle comprises a plurality of nanocrystals with pores disposed between the nanocrystals and throughout the entire porous silicon particle. Alternatively, each porous silicon particle comprises a solid core surrounded by a porous silicon layer having a thickness greater than about 0.5 microns. Because of the processing methods used to prepare the porous silicon particles, the particles have a hydrogen terminated surface which makes them useful as a fuel in the flexible energetic system. Such particles are commercially available from Vesta Research LTD in Ireland and are sold under the trade names: 4E Porous Silicon; 4D Porous Silicon; 4F Porous Silicon; 4C Porous Silicon; 4C21 Porous Silicon; 2E Porous Silicon; 2D Porous Silicon; 2F Porous Silicon; and 2C Porous Silicon.

In one embodiment of the invention, the shaped, flexible fuel is used alone as a source of energy. In this instance, no oxidizer is required. Rather, the shaped, flexible fuel is capable of undergoing self-ignition in air when exposed to temperatures ranging from about 300° C. to about 1000° C.

In yet another embodiment of the invention, a shaped, flexible energetic system comprises at least one oxidizer in combination with the shaped, flexible fuel. Any oxidizer known to one of ordinary skill in the art may be used. Preferably, the oxidizer is selected from the group consisting of: nitrates, perchlorates, chlorates, permanganates, oxides and oxidizing polymers. The oxidizer selected need not be homogenous but also includes a blend of different types of oxidizers. Examples of various oxidizers include but are not limited to perchlorates such as: potassium, sodium, lithium, calcium, iron silver, and ammonium; nitrates such as: potassium, sodium, silver, lithium, and ammonium. In one embodiment of the invention, the oxidizer is blended with a solvent. Any solvent known to one of ordinary skill in the art may be employed and, preferably, the solvents include but are not limited to: hexanes, alcohols and acetone. When the oxidizer is blended with a solvent, a slurry is formed. The slurry is then blended with the shaped, flexible fuel portion. In this embodiment, the solvent acts as a carrier for the oxidizer wherein it carries the oxidizer into the pores of the silicon particles. As the solvent evaporates, the oxidizer remains within the pores of the silicon particles thus impregnating the silicon pores with the oxidizer. The solvent is allowed to evaporate prior to heating (activating) the shaped, flexible fuel portion. Alternatively, the porous silicon particles are mixed with an oxidizer using methods known to one of ordinary skill in the art such as ball milling and sonication by dispersion in an inert solvent.

When poly(tetrafluoroethylene) powder was used as the polymeric binder for the shaped, flexible fuel it was discovered that the powder not only acted as a binder but also acted as an oxidizer. The extent of the oxidation reaction is controlled by the amount of poly(tetrafluoroethylene) powder that is mixed with the porous silicon powder. The poly(tetrafluoroethylene) powder allows for a release of energy to occur in environments that not only contain oxygen but also in oxygen-free environments. As the heating temperature reaches that of the thermal decomposition temperature of the poly(tetrafluoroethylene), a reaction occurs where silicon reacts with fluorine to form silicon tetrafluoride and energy is released.

The porosity, pore volume, and surface area and fuel-oxidizer ratio of the particles are tailored to control the oxidation reaction rate, resulting in burning, deflagration or detonation.

The shaped, flexible fuel is of any shape suitable for the application. In particular, the shape is that of an article, a film, a wire, and a tape. More specifically, such articles include but are not limited to: a cylinder; a cone; and a sphere. Alternatively, these articles serve as blast enhancers when they are combined with secondary explosives. Most preferably, the shaped, flexible fuel portion is a tape. In one embodiment of the invention, the tape has an adhesive affixed to one side. The tape shape facilitates the handling of the shaped, flexible energetic system allowing the system to be wrapped around various substrates or applied to a substrate when an adhesive is affixed to one side. The shaped, flexible fuel portion is shaped by any method known to one of ordinary skill in the art. Most preferably, the shaped, flexible fuel is shaped by: casting, extrusion, and pressing. Casting involves heating of the system to the melting point of the polymeric binding material, pouring the system into a mold and allowing the system to solidify as it cools. Hot isostatic pressing or hydrostatic pressing is another method employed for shaping various articles using the system of the present invention. It should be noted here that when such processes are employed, the processing temperature must be controlled to prevent premature ignition of the material or premature oxidation of the silicon. Ram or screw extrusion processes are also suitable for use in the present invention. The embodiment presented here is such that the tape is formed prior to the addition of an oxidizer. Alternatively, the oxidizer is added to the system prior to shaping. In this instance, the porous silicon particles are mixed with an oxidizer using methods known to one of ordinary skill in the art such as ball milling and sonication by dispersion in an inert solvent.

Since the energetic system of the present invention is shaped, the fuel portion of the system is capable of being oxidized in three dimensions instead of being limited by only two dimensions. The prior art systems are produced from porous silicon produced on a relatively small diameter single crystalline wafer, limiting the extent of the explosive element to a layer having a small thickness. In the system of the instant invention, the shaped system enables three dimensional form and enhanced efficiency of the system.

When the system is shaped after the addition of an oxidizer, the polymeric binding material used in the system of the present invention enables the surface to be passivated. This reduces the chance of pre-mature oxidation of the silicon surface, resulting in a more stable material. The system of the present invention enables the pore size and distribution of the silicon particles to be maintained during processing. Moreover, the present system enables small quantities of materials to be easily handled, thus simplifying the manufacturing process of various articles.

The system of the present invention is suitable for releasing energy into an environment either by detonation or deflagration. In practice, an oxidizer is added to the shaped, flexible fuel portion impregnating the porous silicon particles contained within the shaped, flexible fuel portion. A reaction is initiated in the impregnated silicon particles by either thermal, mechanical, electrical or optical means.

EXAMPLES

Example 1

Preparation of an Energetic Tape

A tape was made using a poly(tetrafluoroethylene) (PTFE) fibrillation process. A 4E grade porous silicon powder having a Brunauer-Emmet-Teller (BET) surface area of 41 $m^2/g$ as measured by nitrogen gas adsorption (commercially available from Vesta Research LTD in Ireland) was mixed with DuPont TEFLON® powder #60 at a ratio of 10:1. The mixture was placed in a crucible and ground together. A small amount of kerosene was added to the mixture to form a plastic mass which was flattened to a sheet. The sheet was passed through rollers in multiple passes with narrowing roller gaps until a tape of approximately 0.010 inches thick was formed. The BET surface area of a small piece of tape was measured using nitrogen gas adsorption and found to be 37 $m^2/g$. Thus, the method of fabrication did not lead to any significant loss in surface area or pore volume. FIG. 1 is a Scanning Electron Micrograph of the tape of the present invention showing porous silicon particles dispersed throughout a TEFLON® polymer matrix. A similar tape was also fabricated from 4E grade powder with a surface area of 118 $m^2/g$.

Example 2

Detonation Testing of the Energetic Properties of the Tape from Example 1

A 25% by weight solution of sodium perchlorate in methanol was formed by dissolving 60 mg of sodium perchlorate monohydrate in 240 mg of methanol. A piece of tape prepared from 4E porous Si with a BET surface area of 118 $m^2/g$ was cut and weighed. The weight was approximately 2 mg. Approximately 20 mg of the 25% by weight solution was mixed with the tape. The solvent was allowed to evaporate at room temperature and the tape allowed to dry. The tape was placed on a hot plate which had been preheated to an ignition temperature of 330° C. After a few seconds, the tape ignited and made an explosive sound.

Example 3

Deflagration Testing of the Energetic Properties of the Tape from Example 1

A 25% by weight solution of sodium perchlorate in methanol was formed by dissolving 60 mg of sodium perchlorate monohydrate in 240 ml of methanol. A piece of tape prepared from 4E porous Si with a BET surface area of 41 $m^2/g$ was cut and weighed. The weight was approximately 2 mg. Approximately 20 mg of the 25% by weight solution was mixed with the tape. The solvent was allowed to evaporate at room temperature and the tape was allowed to dry. The tape was placed on a hot plate which had been preheated to an ignition temperature of 330° C. After less than a second, the tape ignited and exhibited a deflagration reaction.

The above description and drawings are only illustrative of preferred embodiments which achieve the objects, features and advantages of the present invention, and it is not intended that the present invention be limited thereto. Any modification of the present invention which comes within the spirit and scope of the following claims is considered part of the present invention.

What is claimed is:

1. A shaped, flexible fuel comprising: from about 5% to about 70% by weight of poly(tetrafluoroethylene) powder and porous silicon particles prepared from a metallurgical grade silicon powder having particle sizes ranging from about 1 micron to about 100 microns wherein the porous silicon particles have mean pore sizes ranging from about 4 nm-7 nm; surface areas ranging from about 25-300 $m^2/g$; and pore volumes up to about 0.5 cc/g; and wherein the shaped, flexible fuel has a Brunauer-Emmet-Teller (BET) surface area of at least 37 $m^2/g$.

2. A shaped, flexible fuel according to claim 1, wherein the porous silicon particles have an initial particle size ranging from about 1 micron to about 4 microns wherein each porous silicon particle comprises a plurality of nanocrystals with pores disposed between the nanocrystals and throughout the entire porous silicon particle.

3. A shaped, flexible fuel according to claim 1, wherein each porous silicon particle comprises a solid core surrounded by a porous silicon layer having a thickness greater than about 0.5 microns.

4. A shaped, flexible fuel according to claim 1, wherein the shape is selected from the group consisting of: an article; a film; a wire; and a tape.

5. A shaped, flexible fuel according to claim 4, wherein the shape is a tape.

6. A shaped, flexible energetic system according to claim 5, wherein the tape further comprises an adhesive.

7. A shaped, flexible fuel according to claim 4, wherein the article is selected from the group consisting of: a cylinder; a cone; and a sphere.

8. A method for releasing energy into an environment, the method comprising the steps of:

a) providing the shaped, flexible fuel according to claim 1; and b) initiating a reaction in the shaped, flexible fuel wherein energy is released.

9. A method for releasing energy into an environment, the method comprising the steps of:

a) providing the shaped, flexible fuel according to claim 1;

b) adding an oxidizer to the shaped, flexible fuel wherein the porous silicon particles are contacted by the oxidizer; and c) initiating a reaction in the impregnated silicon particles wherein energy is released.

10. A method according to claim 9, wherein the oxidizer is in the form of a slurry and wherein solvent is allowed to evaporate prior to initiating a reaction in the impregnated silicon particles.

11. A method according to claim 9, wherein the reaction is initiated by a means selected from the group consisting of: thermal, mechanical, optical, and electrical.

12. A shaped, flexible energetic system comprising:

the shaped, flexible fuel according to claim 1 and at least one oxidizer.

13. A shaped, flexible energetic system according to claim 12, wherein the oxidizer is selected from the group consisting of: nitrates, perchlorates, chlorates, permanaganates, oxides, and oxidizing polymers.

14. A shaped, flexible energetic system according to claim 13, wherein the oxidizer further comprises a solvent.

15. A shaped, flexible energetic system according to claim 12, wherein the shaped, flexible fuel is selected from the group consisting of: an article; a film; a wire; and a tape.

16. A shaped, flexible energetic system according to claim 15, wherein the shaped, flexible fuel portion is a tape.

17. A shaped, flexible energetic system according to claim 16, wherein the tape further comprises an adhesive.

18. A shaped, flexible energetic system according to claim 15, wherein the article is selected from the group consisting of: a cylinder; a cone; and a sphere.

* * * * *